US009598884B2

(12) United States Patent
Nagaoka et al.

(10) Patent No.: US 9,598,884 B2
(45) **Date of Patent: *Mar. 21, 2017**

(54) VEHICLE DOOR LATCH DEVICE

(71) Applicant: MITSUI KINZOKU ACT CORPORATION, Kanagawa (JP)

(72) Inventors: Tomoharu Nagaoka, Kanagawa (JP); Hiroyuki Sakagami, Kanagawa (JP)

(73) Assignee: MITSUI KINZOKU ACT CORPORATION (JP)

( * ) Notice: Subject to any disclaimer, the term of this patent is extended or adjusted under 35 U.S.C. 154(b) by 472 days.

This patent is subject to a terminal disclaimer.

(21) Appl. No.: 14/157,024

(22) Filed: Jan. 16, 2014

(65) Prior Publication Data

US 2014/0132010 A1 May 15, 2014

Related U.S. Application Data

(63) Continuation of application No. 13/023,625, filed on Feb. 9, 2011, now Pat. No. 8,678,452.

(30) Foreign Application Priority Data

Feb. 15, 2010 (JP) ..... 2010-029837
Sep. 10, 2010 (JP) ..... 2010-203051

(51) Int. Cl.

| | |
|---|---|
| ***E05C 3/06*** | (2006.01) |
| ***E05B 77/26*** | (2014.01) |
| ***E05B 81/00*** | (2014.01) |
| ***E05B 17/00*** | (2006.01) |
| ***E05B 81/04*** | (2014.01) |
| ***E05B 85/02*** | (2014.01) |
| *E05C 3/00* | (2006.01) |

(52) U.S. Cl.

CPC ..... *E05B 77/26* (2013.01); *E05B 17/0029* (2013.01); *E05B 77/265* (2013.01); *E05B 81/00* (2013.01); *E05B 81/04* (2013.01); *E05B 85/02* (2013.01); *Y10T 292/08* (2015.04); *Y10T 292/108* (2015.04); *Y10T 292/1047* (2015.04); *Y10T 292/1082* (2015.04)

(58) Field of Classification Search

CPC ..... E05B 17/0029; E05B 81/00; E05B 81/04
USPC ..... 292/201, 216
See application file for complete search history.

(56) References Cited

U.S. PATENT DOCUMENTS

| | | | |
|---|---|---|---|
| 5,092,638 A | 3/1992 | Mizuki | 292/216 |
| 5,718,465 A | 2/1998 | Dowling et al. | 292/216 |
| 5,802,894 A | 9/1998 | Jahrsetz et al. | 70/264 |
| 6,123,371 A | 9/2000 | Fisher | 292/216 |

(Continued)

FOREIGN PATENT DOCUMENTS

| | | |
|---|---|---|
| GB | 2458549 A | 9/2009 |
| JP | 2009-235805 A | 10/2009 |

*Primary Examiner* — Carlos Lugo
(74) *Attorney, Agent, or Firm* — Ostrolenk Faber LLP

(57) ABSTRACT

In a vehicle door latch device, a latch engages with a striker of a vehicle body and a ratchet engages with the latch, so that a vehicle door is closed, and an inside operating lever and a childproof lock mechanism are disposed between a cover and a casing. To connect the childproof lock mechanism to the casing, the inside operating lever is held in an assembling position and the childproof lock mechanism is held in its locking state or in its unlocking state. The cover has a covering portion over a broader portion of a hole in the cover.

3 Claims, 14 Drawing Sheets

(56) References Cited

U.S. PATENT DOCUMENTS

| | | | | |
|---|---|---|---|---|
| 6,338,508 | B1 | 1/2002 | Kleefeldt | 292/201 |
| 6,343,817 | B1 | 2/2002 | Watanabe | 292/216 |
| 6,382,686 | B1 | 5/2002 | Ishigaki et al. | 292/201 |
| 6,679,532 | B2 * | 1/2004 | Inoue | E05B 81/06 292/201 |
| 6,951,355 | B2 * | 10/2005 | Hayakawa | E05B 81/06 292/201 |
| 7,380,845 | B2 | 6/2008 | Suzumura et al. | 292/216 |
| 7,926,857 | B2 | 4/2011 | Akizuki et al. | 292/201 |
| 8,146,965 | B2 | 4/2012 | Akizuki et al. | 292/201 |
| 8,256,805 | B2 | 9/2012 | Ishiguro | 292/201 |
| 8,267,444 | B2 | 9/2012 | Akizuki et al. | 292/201 |
| 8,662,545 | B2 * | 3/2014 | Taga | E05B 85/02 292/201 |
| 8,678,452 | B2 * | 3/2014 | Nagaoka | E05B 77/265 292/201 |
| 8,851,533 | B2 * | 10/2014 | Akizuki | E05B 65/00 292/200 |
| 2005/0087994 | A1 | 4/2005 | Umino | 292/216 |
| 2006/0006671 | A1 | 1/2006 | Noel et al. | 292/216 |
| 2006/0186675 | A1 | 8/2006 | Suzumura et al. | 292/216 |
| 2006/0290143 | A1 | 12/2006 | Watanabe et al. | 292/216 |
| 2009/0051173 | A1 | 2/2009 | Akizuki et al. | 292/216 |
| 2010/0127511 | A1 | 5/2010 | Vasquez et al. | 292/201 |

* cited by examiner

VEHICLE DOOR LATCH DEVICE

CROSS-REFERENCE TO RELATED APPLICATIONS

This application is a continuation of U.S. patent application Ser. No. 13/023,625, filed Feb. 9, 2011, now U.S. Pat. No. 8,678,452, issued, Mar. 25, 2014, incorporated herein by reference, which claims the benefit of Japanese Patent Application Nos. 2010-029837 and 2010-203051, filed Feb. 15, 2010 and Sep. 10, 2010, respectively, incorporated herein by reference.

BACKGROUND OF THE INVENTION

The present invention relates to a vehicle door latch device having a childproof lock mechanism A conventional vehicle door latch device comprises an inside operating lever operated by an inside handle in the interior of the vehicle; a contact lever for transmitting motion of the inside operating lever to an engagement unit for holding a door closed; and a childproof lock lever that can change between a locking state for disconnecting the inside operating lever from the contact lever and an unlocking state for connecting them, the three levers being overlapped and mounted to the casing, as disclosed in JP2009-235805A.

However, in the door latch device, when the levers are coupled to the casing, the inside operating lever, contact lever and childproof lock lever are freely movable from each other. Thus, when the casing is closed by a cover after the levers are coupled to the casing, each of the levers can deviate from a normal mounting position and the deviated lever will obstruct mounting of the cover to the casing, thereby decreasing assembling efficiency.

SUMMARY OF THE INVENTION

In view of the disadvantage, it is an object of the invention to provide a vehicle door latch device in which an inside operating lever and a childproof lock mechanism are disposed between a casing and a cover, improving efficiency of mounting the cover to the casing.

DETAILED DESCRIPTION OF PREFERRED EMBODIMENTS

Embodiments of the present invention will be described with respect to the drawings. In the description below, the back in FIG. 1 and the left side in FIG. 2 face toward the front of a vehicle, and the front in FIG. 1 and the right side in FIG. 2 face toward the rear of the vehicle. The right side in FIG. 1 and the back in FIG. 2 face toward the exterior of the vehicle, and the left side in FIG. 1 and the front in FIG. 2 face toward the interior of the vehicle.

Figure 1:
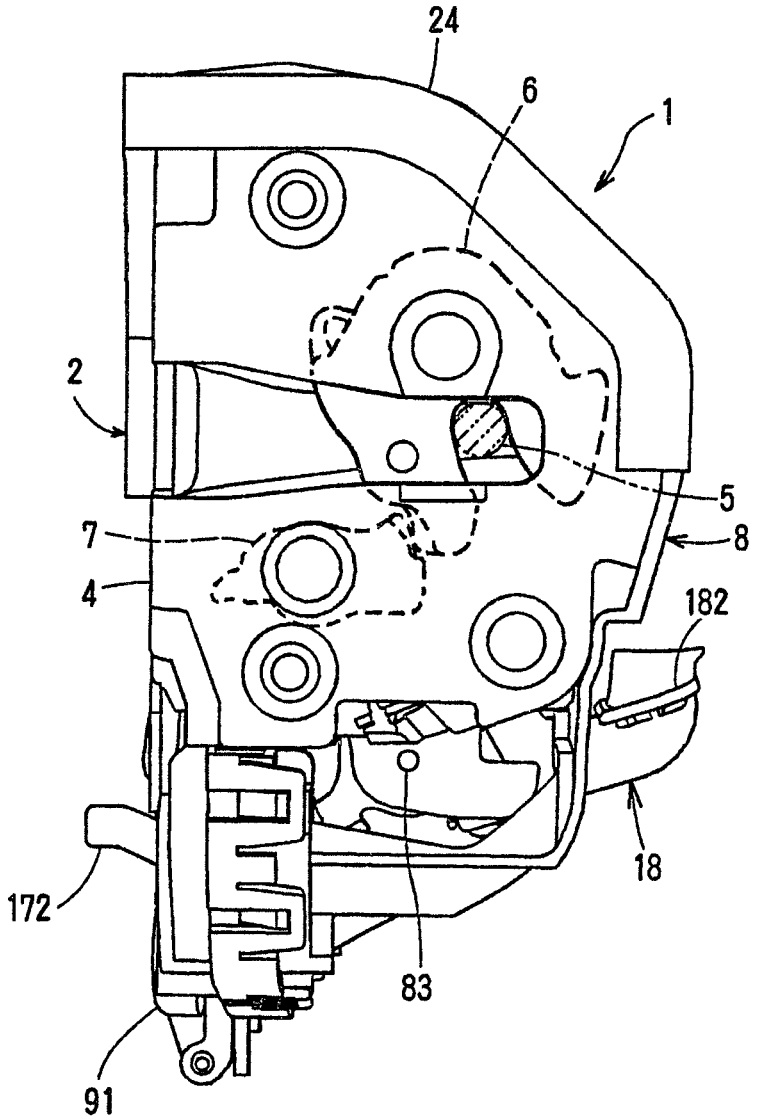
FIG. 1 is a front elevational view of a door latch device according to the present invention.
Figure 2:
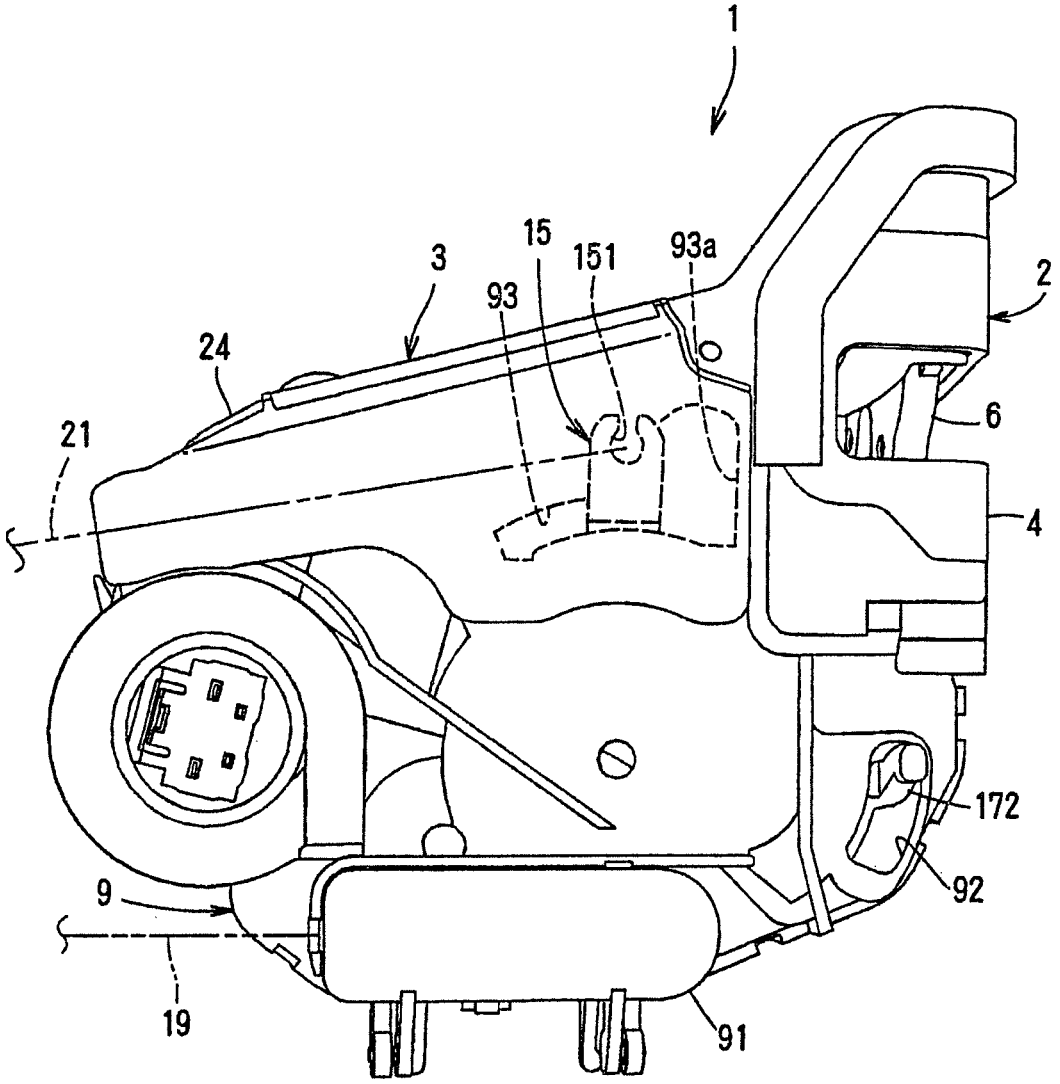
FIG. 2 is a side elevational view of the door latch device.
Figure 3:
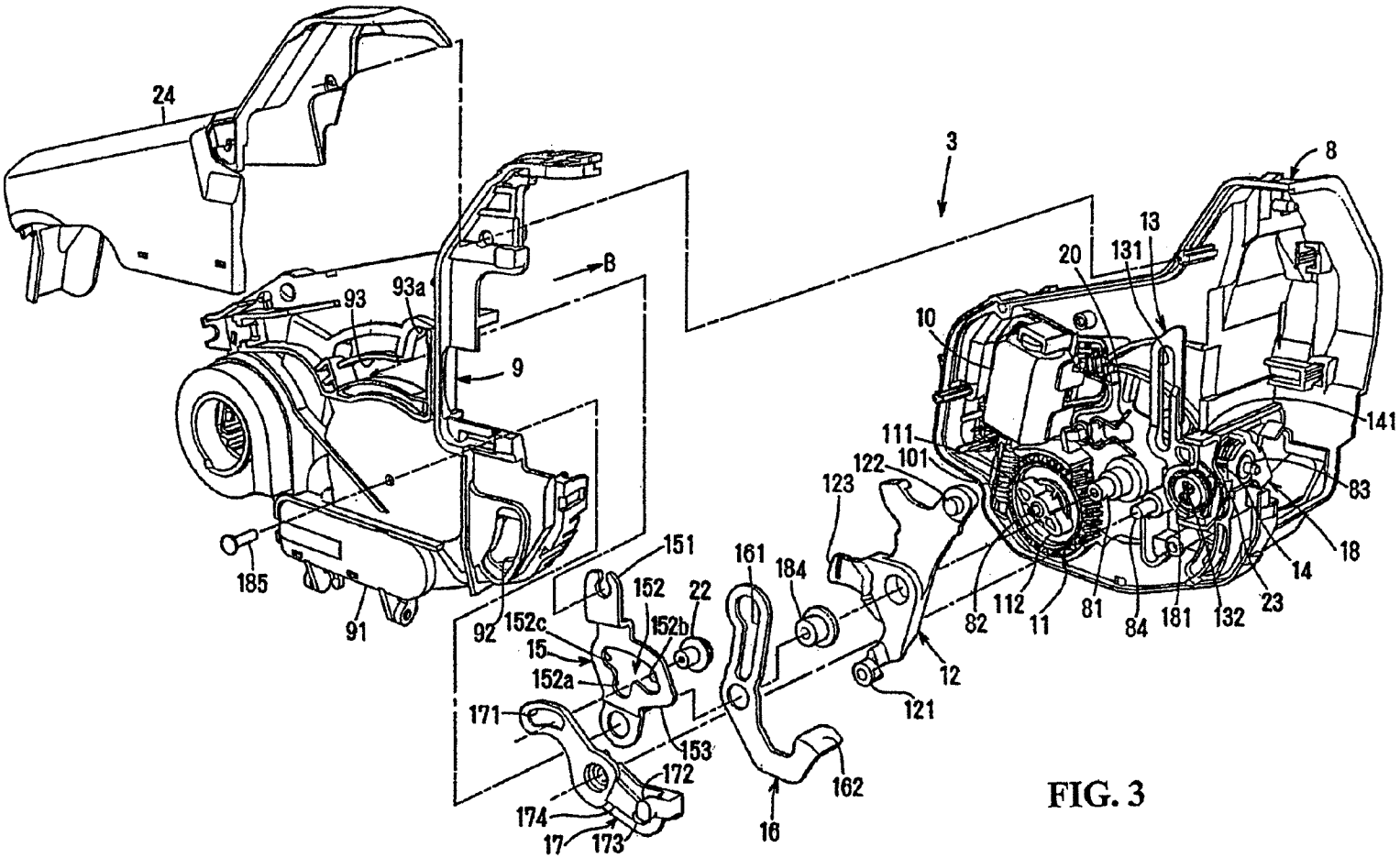
FIG. 3 is an exploded perspective view of an operating unit of the door latch device.

In FIGS. 1-3, a door latch device 1 is mounted on the inside of the rear end of a rear door, and comprises an engagement unit 2 for holding the door closed and an operating unit 3 connected to the engagement unit 2. FIG. 3 does not illustrate the engagement unit 2.

In a synthetic resin body 4 of the engagement unit 2, a latch 6 which engages with a striker 5 of a vehicle body and a ratchet 7 which engages with the latch 6 are disposed. An opening lever 71 which can rotate with the ratchet 7 is pivotally mounted on the front face of the body 4 in FIGS. 4-6. When the door is closed in FIG. 1, the striker 5 engages with the latch 6, and the ratchet 7 engages with the latch 6, preventing the latch 6 from pivoting to open the door clockwise in FIG. 1, so that the door is held closed.

Figure 4:
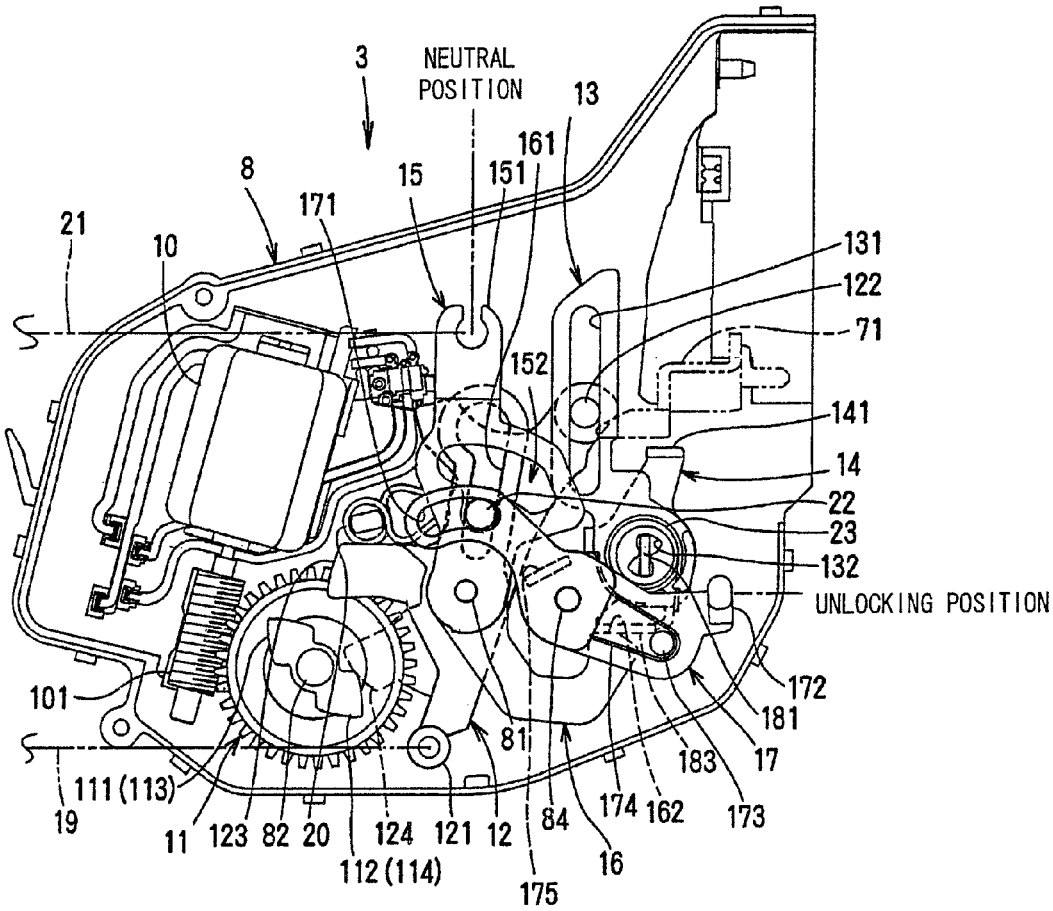
FIG. 4 is a side view of the operating unit to show the internal structure when a locking mechanism and a childproof lock mechanism are both in an unlocking state.
Figure 5:
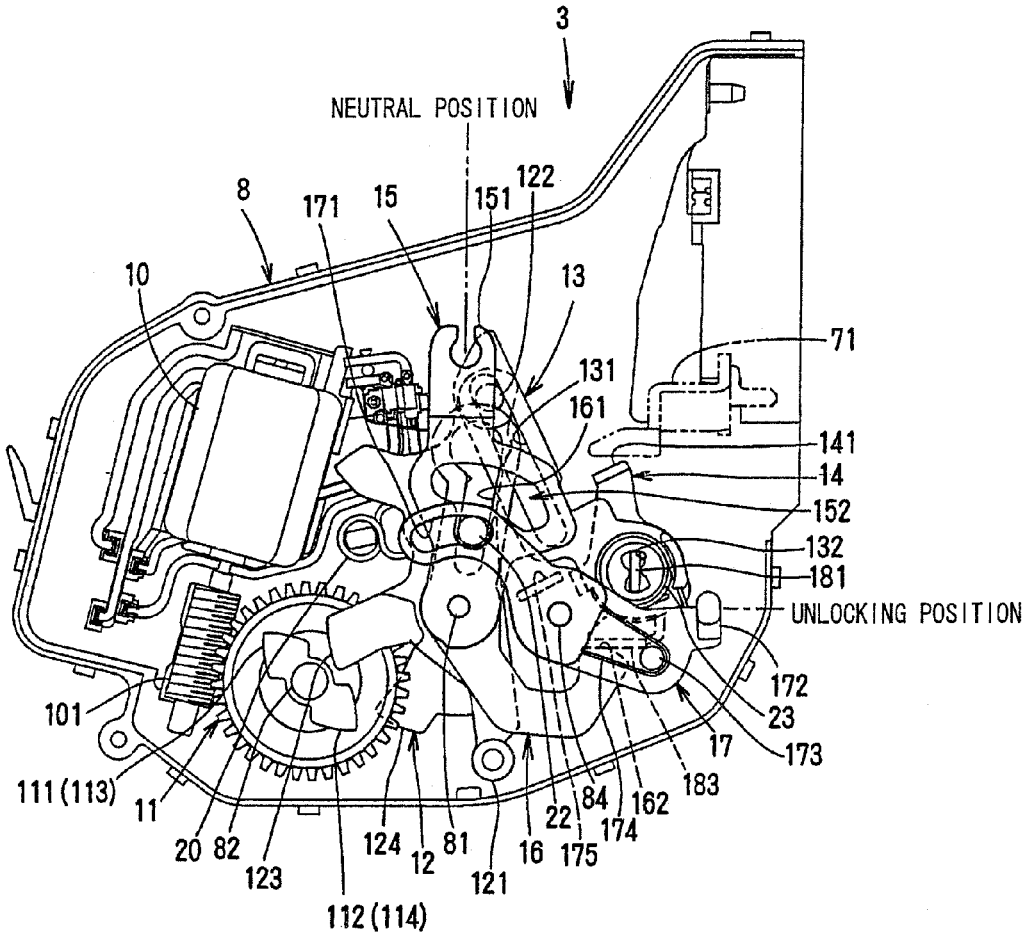
FIG. 5 is a side view of the operating unit to show the internal structure when the locking mechanism and childproof lock mechanism are in a locking state and the unlocking state respectively.
Figure 6:
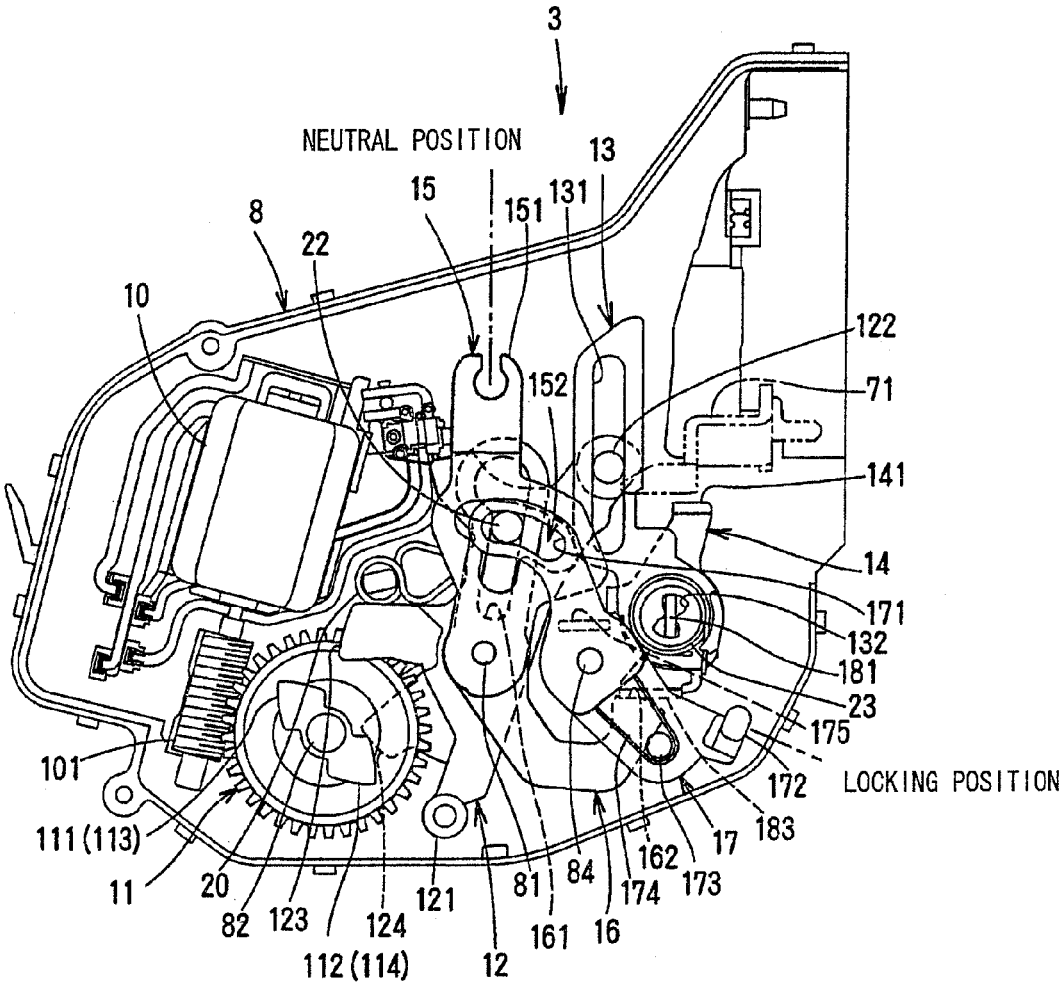
FIG. 6 is a side view of the operating unit to show the internal structure when the locking mechanism and childproof lock mechanism are in the unlocking state and the locking state respectively.

In FIG. 3, the operating unit 3 comprises a synthetic resin casing 8 mounted to the front face of the body 4 like an L in a plan view (not shown), and a synthetic resin cover 9 closing the casing 8 which faces the interior of the vehicle. In a space between the casing 8 and the cover 9, there are a motor 10, a worm wheel 11 which is rotated by the motor 10, a lock lever 12, a first lift lever 13, a second lift lever 14, an inside operating lever 15, a connecting lever 16 and a childproof lock lever 17. On the rear face of the casing 8 on a surface facing the front face of the body 4 of the engagement unit 2, there is an outside operating lever 18. In FIGS. 4-6, the cover 9 is omitted to show the internal structure of the operating unit 3.

In FIGS. 2 and 3, in the upper side of the cover 9, there is an arcuate elongate hole 93 which is part of a circle having a shaft 81 as a center. Through the elongate hole 93, a connecting portion 151 (later described) of the inside operating lever 15 is exposed outside the vehicle and moves therein. At the rear end of the elongate hole 93, there is formed a broader portion 93*a*. When the cover 9 is mounted to the casing 8, a connecting portion 151 of the inside operating lever 15 appears from the broader portion 93*a*. The broader portion 93*a* is formed at the same area as the connecting portion when the inside operating lever 15 is in an assembling position in FIG. 11.

The broader portion 93*a* is disposed at a position where the connecting portion 151 of the inside operating lever 15 cannot move when the door latch device 1 is in use.

At the lower part of the cover 9, a synthetic-resin covering member 91 is mounted to open and close so as to hide the end of a motion transmitting member 19 comprising a rod or a cable that is capable of transmitting motion from a lock knob to a connecting portion 121 which is also hidden by the covering member 91. The covering member 91 is open when each part is assembled in a space between the casing 8 and the cover 9, and is closed after the motion transmitting member 19 is connected to the connecting portion 121 of the lock lever 12. FIGS. 2 and 3 illustrate a condition when the covering member 91 is closed.

A roof cover 24 is mounted over the casing 8 and the cover 9. When the door latch device 1 is mounted in the door, the roof cover 24 prevents rainwater in the door from coming into the space between the casing 8 and the cover 9 via a gap and covers the entire upper surfaces of the casing 8 and the cover 9, and the upper sides including the elongate hole 93. The roof cover 24 is mounted above the motion transmitting member 21 such as a rod or a cable which is connected to the connecting portion 151 of the inside operating lever 15.

The lock lever 12, the inside operating lever 15 and the connecting lever 16 are pivotally mounted via the pivot shaft 81 of the casing 8 between the casing 8 and the cover 9 so as to pivot independently. The lock lever 12, a bearing 184, the connecting lever 16 and the inside operating lever 15 are connected to the pivot shaft 81 in order. After the casing 8 is closed by the cover 9, the casing 8 is fixed to the cover 9 by inserting a binding member 185 into the pivot shaft 81. The childproof lock lever 17 is pivotally mounted via a shaft 84 of the casing 8 between the casing 8 and the cover 9. The lock lever 12, the connecting lever 16, the inside operating lever 15, and the childproof lock lever 17 are connected to the casing 8 in that order in a direction proceeding from the lock lever 12 which is closest to the exterior of the vehicle to the childproof lock lever 17 which is furthest from the exterior of the vehicle.

The lock lever 12 can pivot between an unlocking position where it contacts an unlocking stopper (not shown) of the casing 8 in FIG. 4 and a locking position where it pivots counterclockwise from the unlocking position to contact a locking stopper (not shown) of the casing 8, and is held by force of a spring 20 of the casing 8.

A connecting portion 121 at the lower end of the lock lever 12 is connected to a lock knob via the motion transmitting member 19. Locking and unlocking by the lock knob in the interior of the vehicle is transmitted to the connecting portion 121 via the motion transmitting member 19, so that the lock lever 12 pivots to the unlocking position in FIG. 4 and the locking position in FIG. 5 against force of the spring 20.

A projection 122 at the upper end of the lock lever 12 moves in a vertical elongate opening 131 of a first lift lever 13 to make the lock lever 12 connected to the first lift lever 13.

The lock lever 12 has first and second engagement arms 123,124. The first engagement arm 123 and the second engagement arm 124 are spaced from each other axially with respect to the worm wheel 11 and peripherally of the lock lever 12.

The surface of the first engagement arm 123 is close to and faces one surface of the worm wheel 11 facing the cover 9. The surface of the first engagement arm 123 is capable of engaging with first engagement projections 111,112 on the one surface of the worm wheel 11. The surface of the second engagement arm 124 is close to and faces the other surface of the worm wheel 11 facing the casing 8. The surface of the second engagement arm 124 is capable of engaging with second engagement projections 113,114. The second engagement projections 113,114 are the same shape as the first engagement projections 111,112 and are disposed at symmetrical positions. The numerals 113,114 are shown in parentheses in FIG. 4 and the second engagement projections 113, 114 are not shown.

The worm wheel 11 is pivotally mounted via a shaft 82 of the casing 8 between the casing 8 and the cover 9 and meshes with a worm 101 fixed to a rotary shaft of the motor 10 to rotate normally and reversibly with rotation of the motor 10.

When the lock lever 12 is in the unlocking position in FIG. 4, the first engagement arm 123 of the lock lever 12 is disposed outside a rotation track of the first engagement projections 111,112 of the worm wheel 11, and the second engagement arm 124 is disposed within the rotation track of the second engagement projections 113,114.

When the lock knob is operated to lock the door in the unlocking state in FIG. 4, the lock lever 12 moves to the locking position in FIG. 5 from the unlocking position. The first engagement projections 111,112 of the worm wheel 1 in FIG. 4 are positioned outside a rotation track of the first engagement arm 123 of the lock lever 12, so that the pivoting of the lock lever 12 is not transmitted to the worm wheel 11 by the first engagement arm 123 even if the lock lever 12 pivots from the unlocking position to the locking position. Thus, the worm wheel 11 is not reversed. The lock knob can be operated to lock the door by a small force without resistance for reversing the worm wheel 11 and the motor 10.

When the lock lever 12 is in the locking position in FIG. 5, the first engagement arm 123 of the lock lever 12 is positioned within the rotation track of the first engagement projections 111,112 of the worm wheel 11, while the second engagement arm 124 is disposed outside the rotation track of the second engagement projections 113,114 of the worm wheel 11.

When the lock knob is operated to unlock the door in the locking position in FIG. 5, the lock lever 12 moves from the locking position to the unlocking position in FIG. 4. The engagement projections 111,112,113,114 of the worm wheel 11 are positioned outside the rotation track of the first and second engagement arms 123,124 of the lock lever 12, so that the worm wheel 11 is not reversed. The lock knob can be operated to unlock the door by a small force.

When a switch in the interior or a portable switch is operated to lock the door in the unlocking state in FIG. 4, the motor 10 rotates in a locking direction and the worm wheel 11 turns clockwise from the position in FIG. 4. Thus, the second engagement projection 113 comes in contact with the inner side of the second engagement arm 124 to cause the lock lever 12 to pivot in a locking direction or counterclockwise. When the lock lever 12 moves to the locking position, the second engagement portion 113 of the worm wheel 11 comes off the second engagement arm 124 of the lock lever 12, and the first engagement projection 112 comes in contact with the end of the first engagement arm 123 to stop the worm wheel 11 at the position.

When the switch is operated to unlock the door in the locking state in FIG. 5, the motor 10 turns in the unlocking direction, and the worm wheel 11 turns in the unlocking direction or counterclockwise. The first engagement projection 112 of the worm wheel 11 comes in contact with the inner side of the first engagement arm 123, so that the lock lever 12 pivots in the unlocking direction or clockwise. The first engagement portion 112 of the worm wheel 11 disengages from the first engagement arm 123, and the second engagement projection 113 comes in contact with the end of the second engagement arm 124, so that the worm wheel 11 stops at the position.

The outside operating lever 18 is pivotally mounted by a shaft 83 projecting rearward at the lower part of the casing 8. The first and second lift levers 13,14 are connected to an end 181 of the outside operating lever 18 at the lower ends to sway at a certain angle back and forth. To an outside connecting portion 182 outside the vehicle, an outside handle is connected via a vertical motion transmitting member (not shown). When the outside handle is operated in the exterior of the vehicle, the outside operating lever 18 pivots at a certain angle in an opening direction or clockwise from the neutral position in FIG. 1.

The first lift lever 13 is pivotally mounted by putting the end 181 of the outside operating lever 18 into a bearing hole 132 at the lower part of the first lift lever 13 to pivot back and forth. A projection 122 of the lock lever 12 moves in an elongate hole 131, so that the first lift lever 13 is connected to the lock lever 12.

When the lock lever 12 pivots from the locking position to the unlocking position and vice versa, the first lift lever 13 sways with the lock lever 12 from the unlocking position in FIG. 4 to the locking position in FIG. 5 and vice versa. The outside operating lever 18 pivots to open the door from the neutral position, so that the first lift lever 13 moves to open the door from the locking position of the door upward. The first lift lever 13 moves from the unlocking position to open the door upward when the lock lever 12 is in the unlocking position.

The second lift lever 14 moves together with the first lift lever 13 between the unlocking position in FIG. 4 and the locking position in FIG. 5 on the end of the outside operating lever 18 about the same axis as the first lift lever 13 with the force of the spring 23 acting between the first lift lever 13 and the second lift lever 14. With pivoting of the outside operating lever 18 from the neutral position in the opening direction, the second lift lever 14 moves with the first lift lever 13 in the opening direction or upward.

The second lift lever 14 has a release portion 141 that can come in contact with the opening lever 71. Thus, the second lift lever 14 moves with the first lift lever 13 from the unlocking position in an opening direction, so that the release portion 141 comes in contact with the end of the opening lever 71 thereby pivoting the opening lever 71 in an opening direction, so that the ratchet 7 is released from the latch 6 to open the door. However, if the second lift lever 14 moves with the first lift lever 13 to open the door from the locking position of the first lift lever 13, the release portion 141 moves in front of the opening lever 71 without contacting the end of the opening lever 71, so that the door cannot be opened.

A locking mechanism comprises the lock lever 12 and the first and second lift levers 13,14. Locking and unlocking states of the locking mechanism mean that the lock lever 12 and the first and second lift levers 13,14 are in the locking and unlocking positions respectively. The locking mechanism is not limited to the present embodiment, but the first lift lever 13 may be integrally formed with the second lift lever 14.

The childproof lock lever 17 is pivotally mounted on the shaft 84 extending toward the interior of the vehicle between the casing 8 and the cover 9. By operating an operating portion 172 provided at the rear end of the childproof lock lever 17 and projecting toward the interior of the vehicle, the childproof lock lever 17 pivots between its unlocking position in FIG. 4 and its locking position in FIG. 6 pivoting at a certain angle from its unlocking position. The operating portion 172 is exposed through the elongate hole 92 at the lower part of the cover 9 and an elongate opening (not shown) of the inner panel of the door in the interior of the vehicle thereby enabling manual control.

The childproof lock lever 17 has an arcuate hole 171 which is part of a circle having the shaft 81 as its center. On the surface of the childproof lock lever 17 closer to the shaft 84, there is an elastically deformable tongue 174 which has a projection 173 toward the cover 9. In the cover 9 mounted to the casing 8, the childproof lock lever 17 elastically contacts an unevenness (not shown) on the inner surface of the cover 9 and is elastically held in its unlocking position and its locking position. Thus, unless elastic force is applied to the childproof lock lever 17 in the casing 8 closed by the cover 9, the childproof lock lever 17 will slip off the cover 9 by vibration during assembling of the door latch device 1.

In the arcuate hole 171 of the childproof lock lever 17, a floating member 22 formed by a collar head pin moves.

The childproof lock mechanism according to the present invention comprises the childproof lock lever 17 and the floating member 22 in this embodiment, but is not limited thereto. For example, a link may be used instead of the floating member 22.

The inside operating lever 15 has a connecting portion 151 bent like a crank at the upper end, and the connecting portion 151 is exposed through the elongate hole 93 of the cover 9. The connecting portion 151 is connected to the end of the motion transmitting member 21 such as a cable for transmitting motion to the inside handle (not shown). The inside operating lever 15 pivots at a certain angle counterclockwise from the neutral position in FIG. 4 to open the door. To connect each part to the casing 8 when the end of the motion transmitting member 21 is not connected to the connecting portion 151, the inside operating lever 15 moves to an assembling position in FIG. 11 to which it pivots in a direction opposite to the opening direction from the neutral position where the inside handle is not operated.

Figure 7:
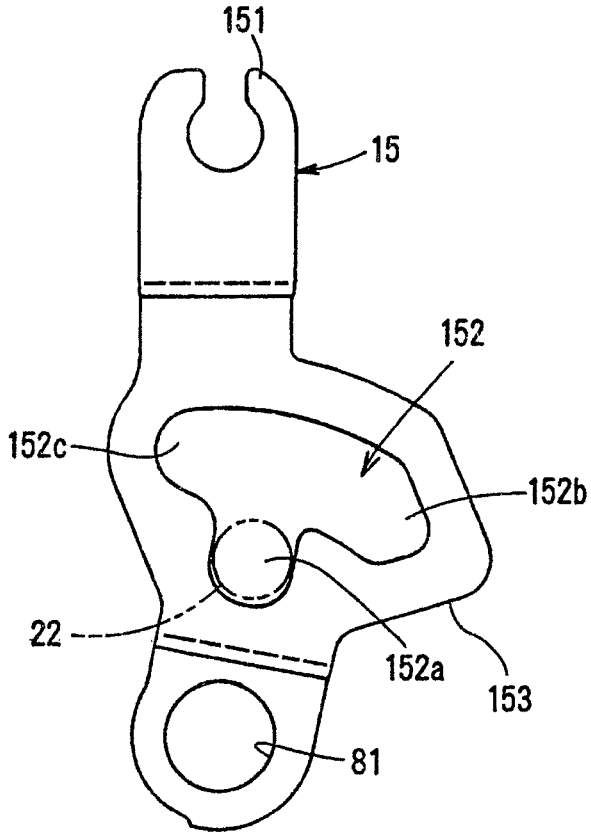
FIG. 7 is a side view of an inside operating lever.

In the inside operating lever 15, there is a t-like control opening 152 below the elongate hole 171 of the childproof lock lever 17, and the floating member 22 moves in the control opening 152. In FIG. 7, the control opening 152 comprises an engagement portion 152*a*, an arcuate portion 152*b* which is part of a circle having the shaft 81 as its center, and a front setting portion 152*c*.

The connecting lever 16 is pivotally mounted on the shaft 81 like the lock lever 12 and the inside operating lever 15 between the casing 8 and the cover 9. Under the elongate opening 171 of the childproof lock lever 17 and the control opening 152 of the inside operating lever 15, an elongate hole 161 is formed in the connecting lever 16.

In the elongate hole 161, the floating member 22 moves vertically with pivoting of the childproof lock lever 17.

Figure 8:
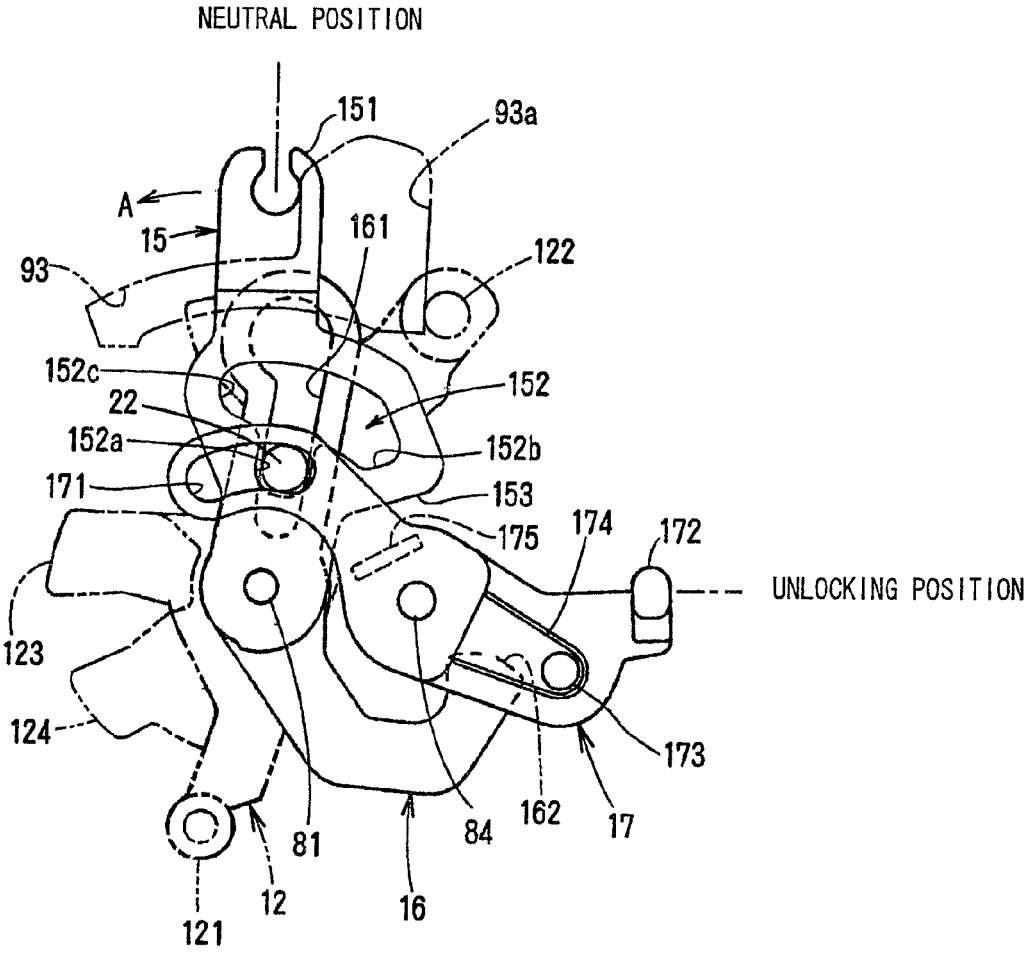
FIG. 8 is a side view when the inside operating lever and childproof lock lever are in a neutral position and in its unlocking position respectively.

When the childproof lock lever 17 and the inside operating lever 15 are in their unlocking position and neutral position respectively in FIG. 8, the floating member 22 is located in the engagement portion 152*a* of the control opening 152 of the inside operating lever 15 and can engage with the inside operating lever 15 in a turning direction. When the childproof lock lever 17 and the inside operating lever 15 are in their locking position and neutral position respectively in FIG. 9, the floating member 22 is in an upper position where it disengages from the engagement portion 152*a* of the control opening 152. When the childproof lock lever 17 is in its locking position and when the inside operating lever 15 is in the opening position in FIG. 10, the floating member 22 can move in the arcuate portion 152*b*. When the childproof lock lever 17 and the inside operating lever 15 are in their locking position and assembling position respectively in FIG. 11, the floating member 22 can move in the setting portion 152*c*.

The unlocking state of the childproof lock mechanism means that the floating member 22 is in the engagement portion 152*a* of the control opening 152, and the locking state of the childproof lock mechanism means that the floating member 22 disengages from the engagement portion 152*a* of the control opening 152 when the childproof lock lever 17 is in its locking position.

A holding unit in the embodiment of this invention comprises the setting portion 152*c* of the control opening 152 of the inside operating lever 15; and the floating member 22 that moves in the control opening 152 and the setting portion 152*c*. When the inside operating lever 15 is in the assembling position, the floating member 22 engages in the setting portion 152*c* to hold the childproof lock lever 17 in its locking position, but it is not limited to this embodiment. For example, when the inside operating lever 15 is in the assembling position while the childproof lock lever 17 is in its unlocking position, the floating member 22 engages in the setting portion 152*c* to hold the childproof lever 17 in its unlocking position. In this case, the setting portion 152*c* extends from the lower end of the engagement portion 152*a* counterclockwise instead of the structure where the setting portion 152*c* extends from the upper end of the engagement portion 152*a* counterclockwise.

For example, in FIG. 8, when the locking mechanism and the childproof lock mechanism are both in unlocking state, the inside operating lever 15 and the connecting lever 16 are connected. On the basis of an opening operation of the inside operating lever 15, the inside operating lever 15 pivots from the neutral position counterclockwise or in a direction of the arrow A in FIG. 8, and the engagement portion 152*a* of the control opening 152 engages with the floating member 22 to allow the floating member 22 to turn with the inside operating lever 15 counterclockwise. Pivoting of the inside operating lever 15 is transmitted to the connecting lever 16 via the floating member 22 and the elongate hole 161, and the connecting lever 16 pivots with the inside operating lever 15 counterclockwise. Pivoting of the connecting lever 16 is transmitted to the outside operating lever 18 by pushing an actuating portion 162 of the connecting lever 16 up onto an actuated portion 183. The outside operating lever 18 pivots from a neutral position to allow a release portion 141 to come in contact with the end of the opening lever 71 which, in turn, pivots to allow the ratchet 7 to disengage from the latch 6, so that the door can be opened.

Figure 9:
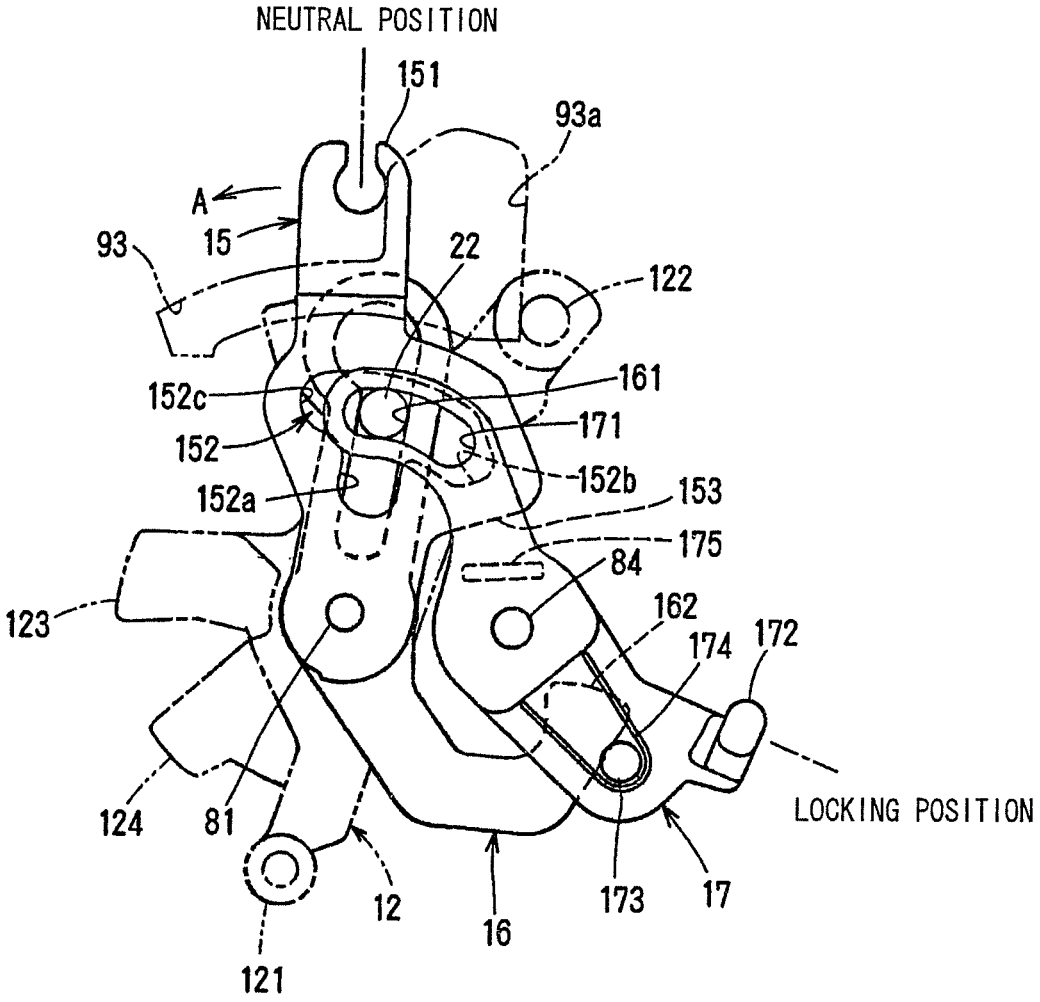
FIG. 9 is a side view when the inside operating lever and childproof lock lever are in the neutral position and in its locking position respectively.
Figure 10:
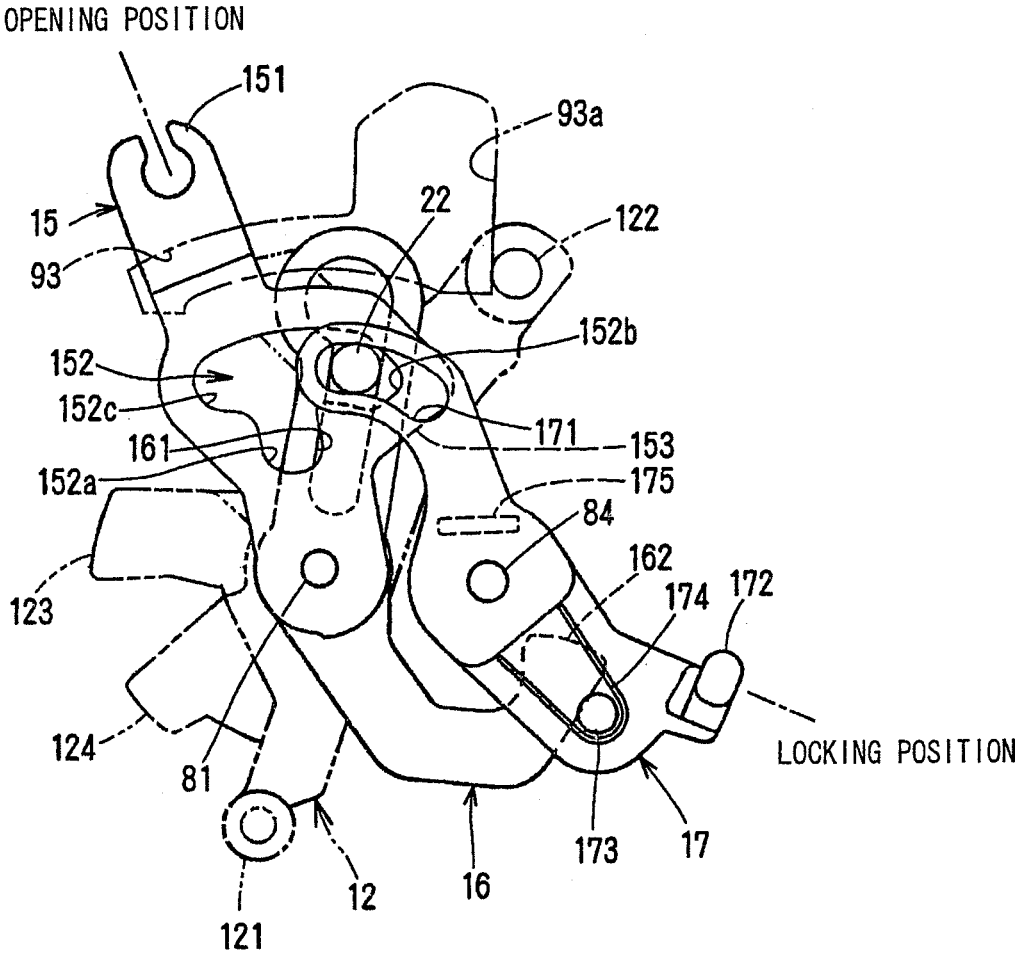
FIG. 10 is a side view when the inside operating lever is in the opening position and the childproof lock lever is in its locking position.

In FIG. 9, when the locking mechanism is in the unlocking state and the childproof lock mechanism is in the locking state, the inside operating lever 15 is disconnected from the connecting lever 16. Even if the inside operating lever 15 pivots by the inside handle counterclockwise or in a direction of the arrow A in FIG. 9, the arcuate portion 152*b* of the control opening 152 moves without contact with the floating member 22, so that the floating member 22 does not move. Thus, pivoting of the inside operating lever 15 is not transmitted to the connecting lever 16 in FIG. 10, so that the door cannot be opened even if the locking mechanism is in the unlocking state.

The inside operating lever 15, the connecting lever 16, the childproof lock lever 17 and the floating member 22 will be assembled as described below.

First, after the lock lever 12 is connected to the shaft 81 of the casing 8, the connecting lever 16 and inside operating lever 15 are connected in order in the interior of the vehicle to a bearing 184 mounted to the shaft 81 of the casing 8. Then, the childproof lock lever 17 is connected to the shaft 84 of the casing 8 in the interior of the vehicle. The floating member 22 is formerly disposed in the elongate hole 161 of the connecting lever 16, and is inserted in the control opening 152 of the inside operating lever 15 and the elongate hole 171 of the childproof lock lever 17 when the inside operating lever 15 and the childproof lock lever 17 are connected.

Figure 11:
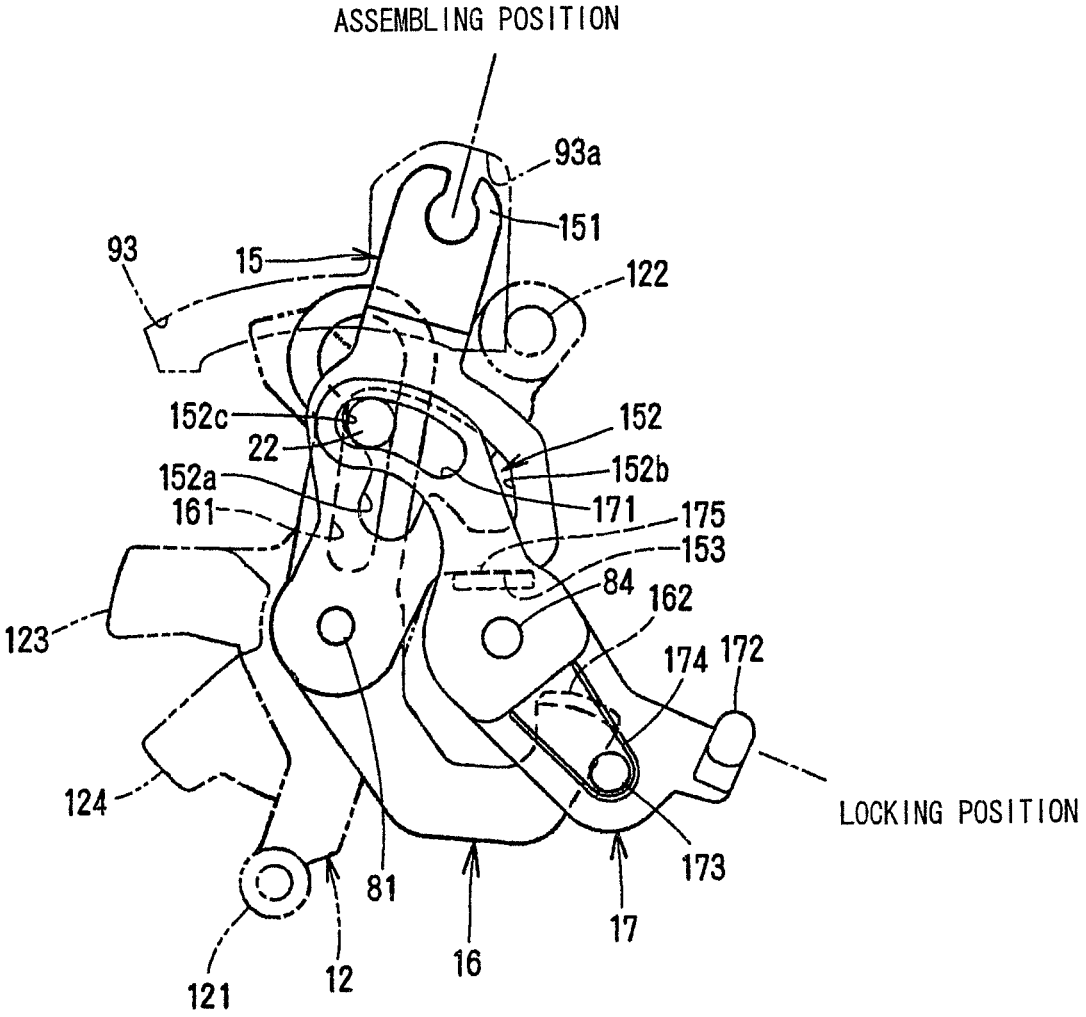
FIG. 11 is a side view when the inside operating lever and childproof lever are in an assembling position and in its locking position.

Then, while the connecting lever 16, the inside operating lever 15 and the childproof lock lever 17 are temporarily assembled in the casing 8, the childproof lock lever 17 is set in its locking position as shown in FIG. 9. The inside operating lever 15 pivots clockwise as shown in FIG. 11 and is set in an assembling position. Thus, the floating member 22 engages on the upper and lower edges of the setting portion 152*c* of the control opening 152 of the inside operating lever 15. The childproof lock lever 17 is held not to move to another position from its locking position by vibration during assembling. Therefore so long as the inside operating lever 15 is held in the assembling position, the childproof lock lever 17 does not move from its locking position. During assembling, the levers 15,16,17 do not move from their normal positions without a reason.

While the inside operating lever 15 and the childproof lock lever 17 are held in the assembling position and its locking position respectively, the cover 9 is mounted to the casing 8 in the same direction as the levers 15,16,17 are mounted or in a direction of an arrow B in FIG. 3, and the casing 8 is closed. In the assembling position, the connecting portion 151 of the inside operating lever 15 is exposed through the broader portion 93*a* of the elongate hole 93 of the cover 9. So, without moving the cover 9 in a direction perpendicular to the connecting direction or arrow B, the cover 9 is connected to the casing 8 straight to allow the connecting portion 151 of the inside operating lever 15 to be exposed outside the cover 9 through the broader portion 93*a*. At the same time, the childproof lock lever 17 is held in its locking position to allow the operating portion 172 of the childproof lock lever 17 to be exposed outside the cover 9 through the elongate hole 92 of the cover 9.

The casing 8 is closed by the cover 9. Since elastic force is applied to the childproof lock lever 17 for holding the childproof lock lever 17 in the unlocking and locking positions elastically due to the projection 173 of the childproof lock lever 17 being in contact with unevenness on the inner surface of the cover 9 elastically, the childproof lock lever 17 pivots from its locking position in FIG. 11 to its unlocking position against the elastic force applied to the childproof lock lever 17. Thus, a projection 175 of the childproof lock lever 17 comes in contact with an edge of the inside operating lever 15, and with pivoting of the childproof lock lever 17 from its locking position to its unlocking position, the inside operating lever 15 pivots from the assembling position to the neutral position. With pivoting of the childproof lock lever 17 from its locking position to its unlocking position and with pivoting of the inside operating lever 15 from the assembling position to the neutral position, the floating member 22 moves into the engagement portion 152*a* from the setting portion 152*c* of the control opening 152 of the inside operating lever 15.

When the door latch device 1 is supplied to automobile manufacturers, the childproof lock mechanism and inside operating lever 15 are set in the unlocking state and neutral position respectively. By moving the childproof lock lever 17 from its locking position to its unlocking position, the inside operating lever 15 can be moved to the neutral position thereby assembling the door latch device 1 more efficiently.

When the inside operating lever 15 moves to the neutral position, the connecting portion 151 of the inside operating lever 15 moves forward along the elongate hole 93 to the middle from the broader portion 93*a*. The connecting portion 151 of the inside operating lever 15 exposed from the middle of the elongate hole 93 of the cover 9 is connected to the end of the motion transmitting member 21, and a roof cover 24 is mounted on the casing 8 and the cover 9 to hide the elongate hole 93, the broader portion 93*a* and the connecting portion 151.

When the door latch device 1 is mounted in the door, the connecting portion 151 moves along the elongate hole 93 by the inside operating lever 15 operated by the inside handle, but does not move to the broader portion 93*a*. Therefore, when the inside operating lever 15 is operated, the connecting portion 151 does not catch on the edge of the broader portion 93*a* or does not make the operation of the inside handle worse.

Figure 12:
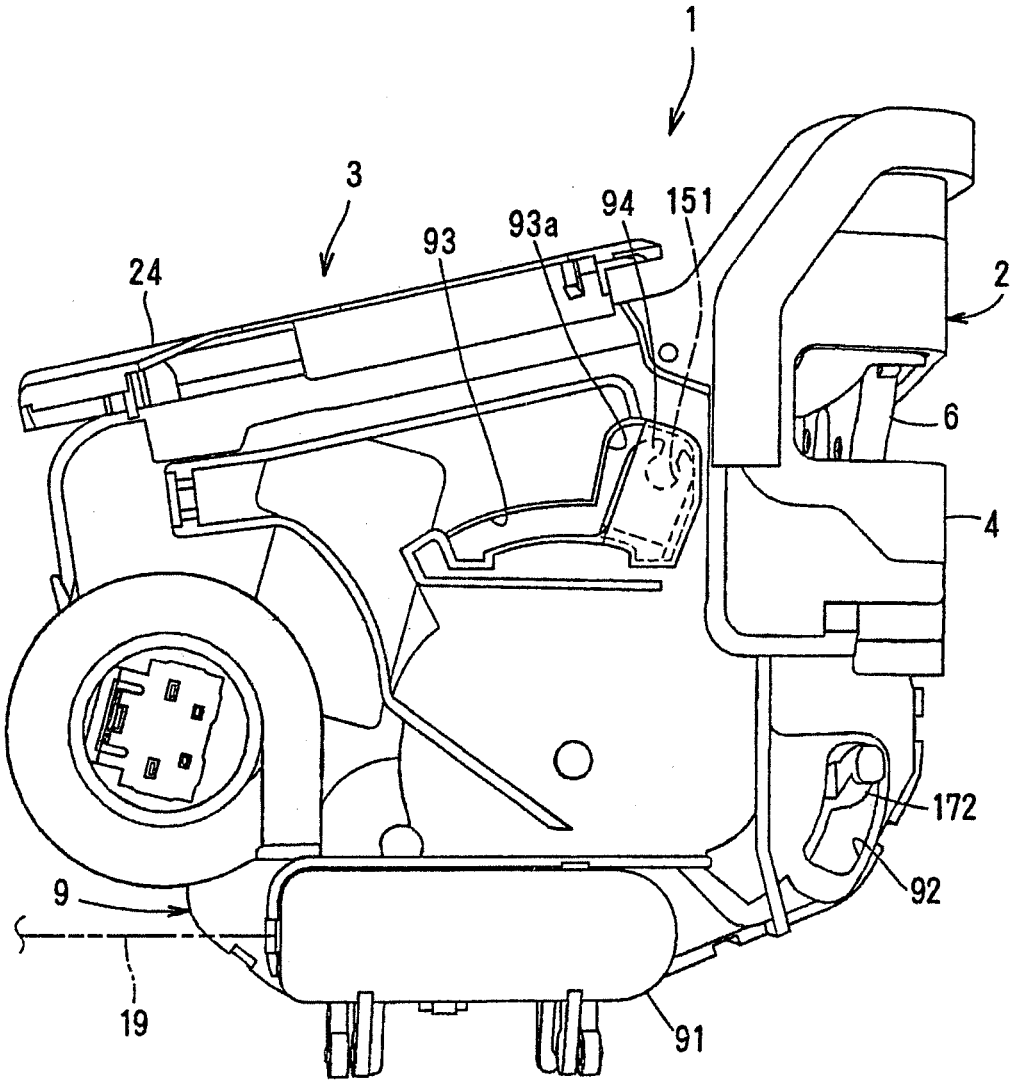
FIG. 12 is a side view when an inside operating lever is in an assembling position in another embodiment.
Figure 13:
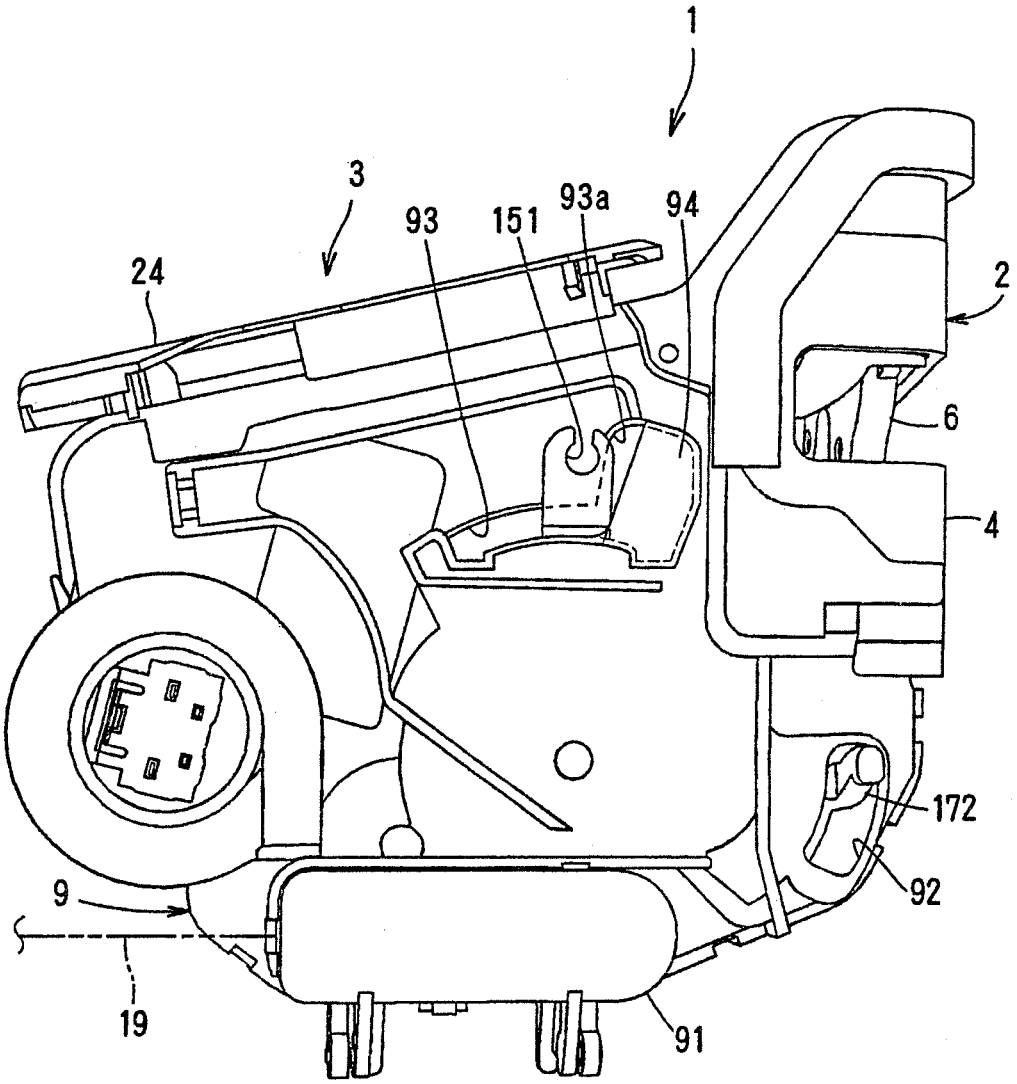
FIG. 13 is a side view of a door latch device when the inside operating lever is in a neutral position in another embodiment.
Figure 14:
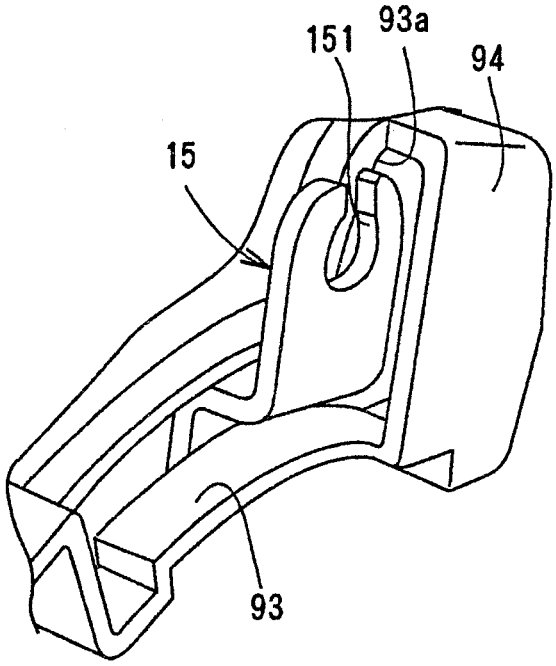
FIG. 14 is a perspective view in another embodiment.

FIGS. 12-14 show another embodiment of the present invention. FIG. 12 shows that an inside operating lever 15 is in an assembling position; FIG. 13 shows that the inside operating lever 15 is in a neutral position, and FIG. 14 shows a perspective view of the inside operating lever 15. FIGS. 12 and 13 show that a roof cover 24 is open.

In the embodiment, in addition to the elements in the foregoing embodiment, a covering portion 94 for covering a broader portion 93*a* is integrally formed with a cover 9. Except the covering portion, the embodiment is the same as the foregoing embodiment. The difference will be only described, and the part of the foregoing embodiment which is the same in this embodiment will not be described.

The covering portion 94 is closed at the upper and lower parts and rear part and is open at the front part. When a connecting portion 151 of the inside operating lever 15 in an assembling position is disposed in the broader portion 93*a* in FIG. 12, the connecting portion 151 is covered with the covering portion 94 from the side of the interior of the vehicle. When the connecting portion 151 of the inside operating lever 15 in a neutral position is in the middle of the elongate hole 93, the connecting portion 151 is exposed from the covering portion 94 to enable the motion transmitting member 21 to be coupled to the connecting portion 151.

Thus, when the inside operating lever 15 is in the assembling position, the connecting portion 151 is covered with the covering portion 94, so that the end of the motion transmitting member 21 cannot be coupled to the connecting portion 151. If the connecting portion 151 is coupled to the motion transmitting member 21 when the inside operating lever 15 is in the neutral position, the motion transmitting member 21 will not be connected in error. The roof cover 24 is closed after the motion transmitting member 21 is coupled to the connecting portion 151 of the inside operating lever 15 in the neutral position.

The broader portion 93*a* is covered with the covering portion 94. When the door latch device 1 is mounted in the door, the covering portion 94 will prevent rainwater from coming into the casing 8 through the broader portion 93*a* even if a lot of rainwater in the door comes into a gap between the roof cover 24 and the cover 9.

The embodiment comprises the casing 8; the cover 9 for closing the casing 8; the inside operating lever 15 between the casing 8 and the cover 9 operable by an inside handle from the neutral position to open the door, the inside operating lever 15 moving from the neutral position opposite the direction for opening when the inside operating lever 15 is assembled to the casing 8; a connecting lever 16 between the casing 8 and the cover 9 that can transmit opening action of the inside operating lever 15 to an engagement unit 2 via a second lift lever 14; a childproof lock mechanism comprising a childproof lock lever 17 and a floating member 22 between the casing 8 and the cover 9, the childproof lock mechanism being selectable between a locking state which can release connection between the inside operating lever 15 and the connecting lever 16 and an unlocking state which can make connection between the inside operating lever 15 and the connecting lever 16; and a holding unit comprising a setting portion 152*c* of a control opening 152 and the floating member 22, the holding unit holding the childproof lock mechanism in a locking or unlocking state when the inside operating lever 15 is in the assembling position, the holding unit releasing holding of the childproof lock mechanism by moving the inside operating lever 15 from the assembling position to the neutral position. Thus, the childproof lock lever 17 is held, so that the cover 9 to the casing 8 can be mounted more efficiently when the inside operating lever 15, the childproof lock lever 17 and the cover 9 are mounted to the casing 8.

The foregoing merely relates to embodiments of the present invention. Various modifications and changes may be made by a person skilled in the art without departing from the scope of claims wherein:

What is claimed is:

1. A vehicle door latch device comprising:

a latch configured to engage with a striker of a vehicle body to keep a vehicle door closed;

a ratchet configured to engage with the latch so as to maintain engagement of the latch with the striker;

a casing:

a cover closing the casing and having an elongate hole which has a broader portion at an end of the elongate hole, the cover having a covering portion covering the broader portion of the elongate hole;

an inside operating lever disposed between the casing and the cover and moving from a neutral position to open a door by operating an inside handle in a vehicle to an assembling position opposite to a direction for opening the door from the neutral position, the inside operating lever comprising a connecting portion exposed outside the cover through the elongate hole of the cover and coupled to a motion transmitting member transmitting motion of the inside handle, the connecting portion appearing from the broader portion of the elongate hole of the cover when the inside operating lever is in the assembling position;

a connecting lever disposed between the casing and the cover and transmitting motion of the inside operating lever for opening the door, to an engagement unit for holding the door closed;

a childproof lock mechanism disposed between the casing and the cover and moving between an unlocking state where the motion of the inside operating lever for opening the door can be transmitted to the connecting lever and a locking state where the motion cannot be transmitted, the childproof lock mechanism comprising a childproof lock lever pivotally mounted between the cover and the casing and movable between its locking position and its unlocking position; and a holding unit holding the childproof lock mechanism in the locking state or the unlocking state when the inside operating lever is in the assembling position, while the childproof lock mechanism is not held in the locking state or the unlocking state when the inside operating lever is in the neutral position, the holding unit comprising a floating member movable in a control opening of the inside operating lever and in an elongate hole of the childproof lock lever, and a setting portion of the control opening of the inside operating lever, the floating member engaging in the setting portion of the control opening to hold the childproof lock lever in its unlocking or locking position.

2. The vehicle door latch device of claim 1 wherein the holding unit holds the childproof lock mechanism in its locking position, the childproof lock lever switching from its locking position to its unlocking position to allow the inside operating lever to move from the assembling position to the neutral position.

3. The vehicle door latch device of claim 1 wherein the floating member comprises a floating pin.

* * * * *